US006962117B2

(12) United States Patent
Barry

(10) Patent No.: US 6,962,117 B2
(45) Date of Patent: Nov. 8, 2005

(54) METHOD AND APPARATUS FOR CONTROLLING COMBUSTION IN A FURNACE

(76) Inventor: Louis T. Barry, 11 Pin Oak Rd., Skillman, NJ (US) 08558

( * ) Notice: Subject to any disclaimer, the term of this patent is extended or adjusted under 35 U.S.C. 154(b) by 0 days.

(21) Appl. No.: 10/815,452

(22) Filed: Apr. 1, 2004

(65) Prior Publication Data

US 2005/0217545 A1 Oct. 6, 2005

(51) Int. Cl.[7] ..... F23C 9/00; F23B 7/00

(52) U.S. Cl. ..... 110/204; 110/295; 110/342

(58) Field of Search ..... 110/204, 295, 342, 110/215

(56) References Cited

U.S. PATENT DOCUMENTS

| | | | | |
|---|---|---|---|---|
| 3,958,920 A * | 5/1976 | Anderson | ..... | 432/23 |
| 4,046,085 A | 9/1977 | Barry et al. | ..... | 110/12 |
| 5,400,723 A * | 3/1995 | Okuno et al. | ..... | 110/235 |
| 5,957,064 A | 9/1999 | Barry et al. | ..... | 110/188 |

* cited by examiner

*Primary Examiner*—Kenneth Rinehart
(74) *Attorney, Agent, or Firm*—Kaplan Gilman Gibson & Dernier LLP

(57) ABSTRACT

A method and system for controlling the combustion in a furnace in which the flue gas generated by the burning in the combustion zone is fed back to the combustion zone through a recirculation path to cool the combustion zone so that the temperature is below the melting or softening point of the residual ash in the solid materials. Water is heated and vaporized by the flue gas so as to cool the flue gas. Generated water vapor is also introduced to the combustion zone to increase the burning rate.

14 Claims, 3 Drawing Sheets

METHOD AND APPARATUS FOR CONTROLLING COMBUSTION IN A FURNACE

TECHNICAL FIELD OF THE INVENTION

The present invention relates to incineration, and more particularly, to a method and system for controlling the combustion in a furnace, such as in a multiple hearth furnace used in waste treatment industry.

BACKGROUND OF THE INVENTION

The safe disposal of certain toxic waste is difficult to achieve since removal of the toxins from the waste usually involves complex systems. For example, the fly ash from a coal burning furnace includes toxic levels of mercury, which render the ash unsuitable for subsequent use or easy disposal, such as in a land fill. With land fills becoming over filled, pressure from environmental groups mounting, and legislation directed at stopping many kinds of dumping (such as ocean dumping), incineration of the waste is becoming more popular.

A multiple hearth furnace is conventionally used for treating sludge, garbage, etc., such as from a waste water treatment plant. FIG. 1 shows a counter-flow multiple hearth furnace 100 which usually comprises a feed zone 110 (also serving as a drying zone if the waste to be burned is wet), a combustion zone 120 and a cooling zone 130. Each zone may include a plurality of hearths. The waste, which may be wet, is fed from above through the drying or feed zone 110 so as to be dried by the flue gas, and becomes solidified. The solidified material enters the combustion zone 120 to be burned.

A fan 140 is operable to introduce air through the cooling zone 130 and into the combustion zone 120 from below. In this way the incinerated material from the combustion zone 120 is cooled by the air before exiting the furnace through the output port 131. Exhaust gas exits the drying or feed zone 110 through an exhaust gas port 111.

Almost all materials that are incinerated produce a residual ash. The softening and melting points of the residual ash are important parameters to the combustion operation. In particular, if the temperature of the bed of burning solid material reaches the softening point, of the residual ash, the solid material will become sticky, clog the system, and interfere with rapid incineration of the waste. Therefore, the temperature in the combustion zone 120, especially in the bed of solid material, must be controlled such that it is lower than the melting point, and preferably lower than the softening point, of the residual ash.

A solution to the clogging problem is to cool the combustion zone 120 using large volumes of excess air. However, excess air tends to increase the gas phase oxygen concentration, which increases the burning rate of the solid material, and, thereby the temperature of the bed of the burning solid material. The increased air in the system may also result in other problems, such as extinguished combustion and quenching effect. Another problem occurs in some multiple hearth furnaces when more air is introduced into the system, particularly in furnaces that heat the exhaust gas at the top of the furnaces or are forced to afterburn the entire furnace exhaust gas for pollution control. Indeed, some states require that the exhaust gas exit at a specified temperature, such as 1500 degrees Fahrenheit, which usually means that fuel is added to the gas and ignited just prior to exiting the furnace, or in a subsequent external combustion chamber. Thus, with increased air in the system, more fuel is required to heat or burn the exhaust gas so as to raise the exhaust gas temperature, thereby increasing processing costs.

U.S. Pat. No. 5,957,064 discloses a flue gas recirculation (FGR) system to cool the temperature of the combustion zone. In particular, the flue gas from the drying or feed zone is fed back into the combustion zone through the cooling zone. Typically the bed temperature of an FGR system like this is about 300–500 degrees Fahrenheit lower than that of other furnaces because the recirculating flue gas in the combustion zone helps to limit the peak temperature of both the gas and the solid material. Moreover, introducing flue gas into the combustion zone may decrease the oxygen concentration, thereby decreasing the combustion rate and lowering the solids burning temperature. However, this approach lowers the burning rate, as measured by mass burned per hour per square foot of furnace hearth area, thereby increasing the size of the furnace and cost for a given combustion mass rate.

Therefore, there is a need in the art for an improved method of incinerating waste, which limits the temperature of the combustion zone without sacrificing the solid material burning rate of the furnace.

SUMMARY OF THE INVENTION

To realize the above object, the present invention provides a method and system for controlling the combustion within the furnace, in which the flue gas is fed back to the combustion zone via a recirculation path to limit both the gas and solid material temperatures in the combustion zone. In particular, as taught by the present invention, the flue gas is used to heat water so as to generate water vapor which is also introduced into the combustion zone, and at the same time, the flue gas is cooled by losing heat to the water before it enters the combustion zone, which helps to lower the temperature of the combustion zone. Further, the water vapor introduced into the combustion zone increases the burning rate of the solid material. Preferably, the water is introduced into the flue gas in the recirculation path, and the generated water vapor is introduced to the combustion zone together with the flue gas.

BRIEF DESCRIPTION OF THE DRAWINGS

The above and further features and advantages of the present invention will be clearer from reading the detailed description of the preferred embodiments of the present invention with reference to the accompanying drawings in which.

DETAILED DESCRIPTION OF THE PREFERRED EMBODIMENTS

Figure 1:
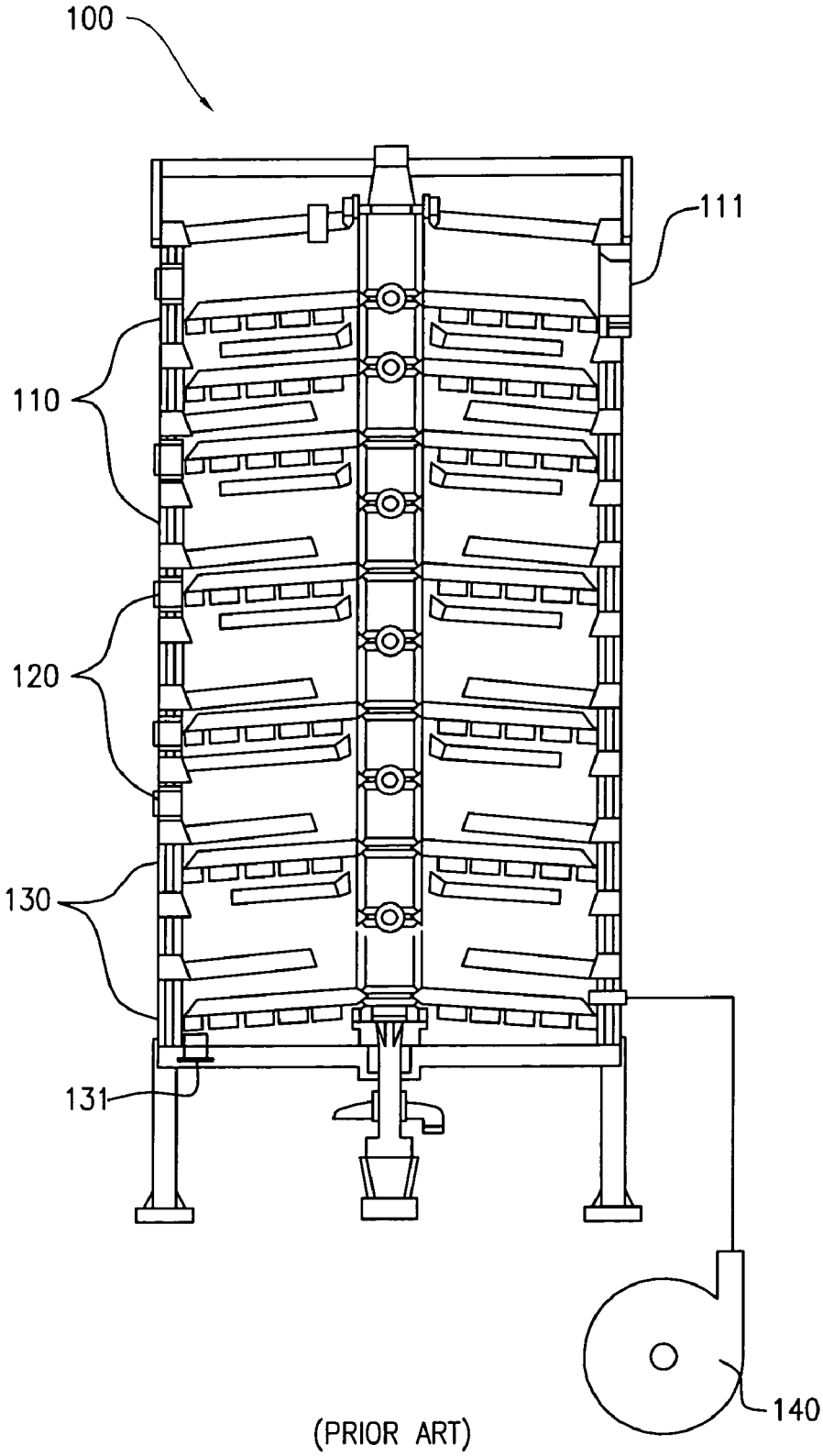
(PRIOR ART) FIG. 1
FIG. 1 illustrates a conventional multiple hearth furnace of the prior art.
Figure 2:
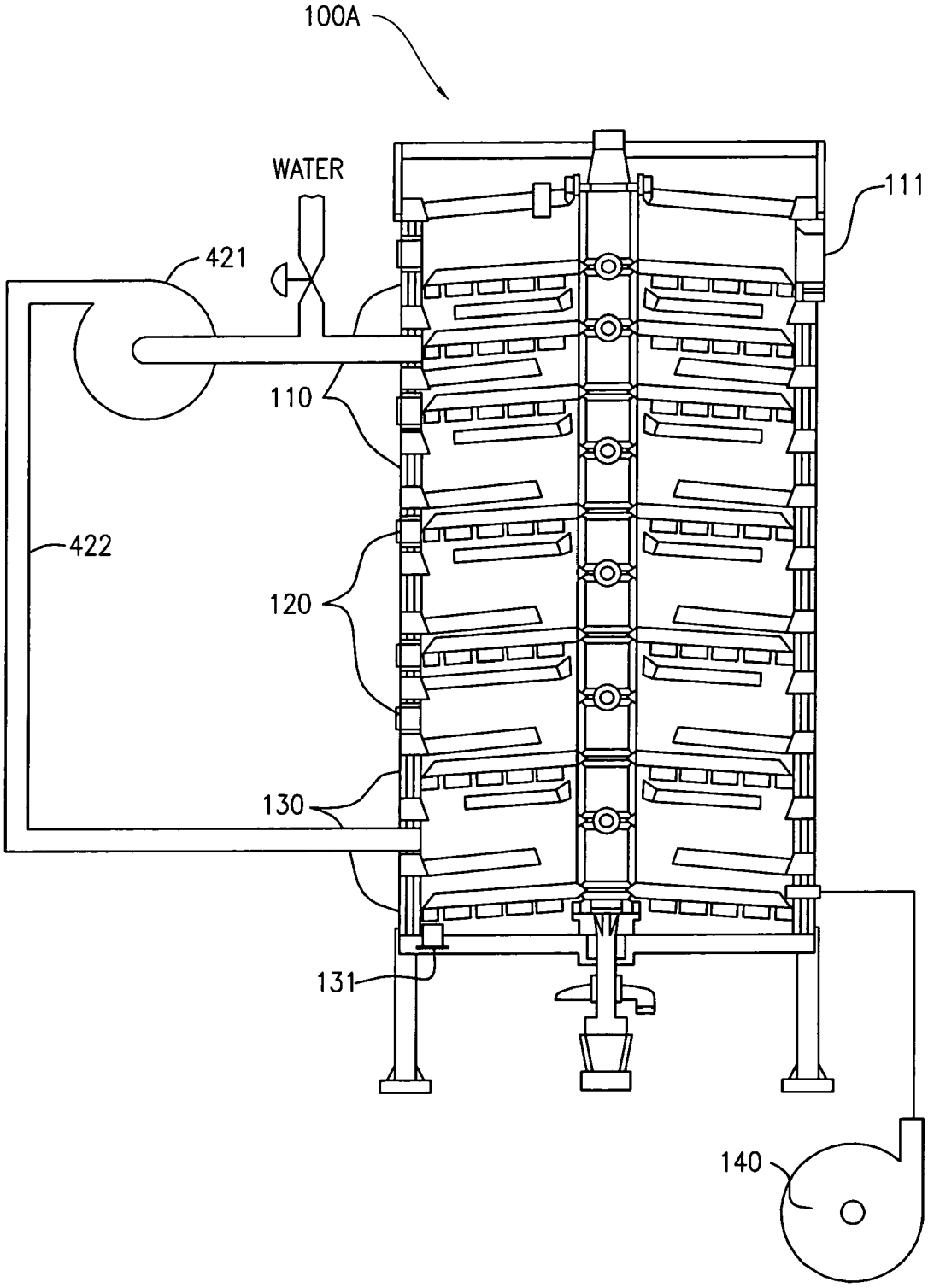
FIG. 2 is an exemplary embodiment of the present invention comprising a recirculation path of the flue gas.

Reference is made to FIG. 2, in which an exemplary embodiment of a multiple hearth furnace 100A in accordance with the present invention is illustrated. As shown in FIG. 2, a recirculation pipe or path 422 is provided for the flue gas to be fed back from the drying or feed zone 110 to the combustion zone 120 from below through the cooling zone 130. Alternatively, the recirculation pipe 422 can be arranged to feed the flue gas directly into the combustion zone 120. A fan 421 is provided in the path 422 to extract the flue gas from the drying or feed zone 110. The amount of flue gas to be fed back to the combustion zone 120 can be controlled by adjusting the cubic feet per minute (CFM) of the fan 421. Remaining flue gas may exit the drying or feed zone from the exhaust gas port 111. The flue gas increases the efficiency of the system for burning solid material by limiting the temperature of the combustion zone 120.

According to the present invention, the flue gas is used to generate water vapor by heating the water that is introduced into the path 422 to mix with the flue gas. The water is vaporized by the heat of the flue gas. The generated water vapor is fed into the furnace at or below the combustion zone 120 together with the flue gas along the recirculation path 422. Because the water is heated and vaporized by the heat of the flue gas, the flue gas is considerably cooled, e.g., from about 1400 degrees Fahrenheit in the drying or feed zone 110 to about 600 degrees Fahrenheit after evaporation of the water. Compared to the flue gas recirculation system disclosed in U.S. Pat. No. 5,957,064, such cooled flue gas (of much lower temperature) significantly improves in cooling the combustion zone 120. At the same time, the burning rate is less sacrificed because less flue gas is required to limit the temperature of the combustion zone 120, therefore the oxygen concentration in the combustion zone 120 is less decreased.

Moreover, introducing the water vapor into the combustion zone 120 increases the burning rate without increasing the temperature of the burning solid material in the combustion zone 120. For example, when the furnace is used to incinerate fly ash from a coal burning furnace, the exothermic reaction between oxygen and residual carbon contained in the fly ash is balanced in part by the endothermic reaction between the steam and carbon. More specifically, if the bed of solid material (including carbon) is hot enough, the carbon will react with the water vapor according to the reaction $C+H_2O \rightleftharpoons H_2+CO$, which is an endothermic reaction that cools the bed. The CO and $H_2$ thus formed are burned when they diffuse into the gas phase in the presence of free oxygen. This regenerates the water vapor according to the reaction $CO+H_2+O_2 \rightleftharpoons CO_2+H_2O$. It is noted that this is an exothermic reaction that heats the gas phase without overheating the solid material in the bed.

Therefore, in accordance with one or more aspects of the present invention, the temperature of the solid material within the combustion zone 120 can be efficiently controlled within a limit, e.g., below the melting point (and preferably below the softening point) of the residual ash in the solid material, without lowering the burning rate.

In the foregoing example, controlled incineration of the fly ash from the coal burning furnace may burn off the carbon, leaving a substantially carbon free ash plus mercury vapor. The mercury vapor may be removed using a heat exchanger and powdered activated carbon system. The resulting substantially carbon and mercury free ash may be used in subsequent commerce, such as a filler for concrete. Without this incineration process, the ash was both toxic and carbon rich, making it unsuitable for nearly any commercial venture.

Figure 3:
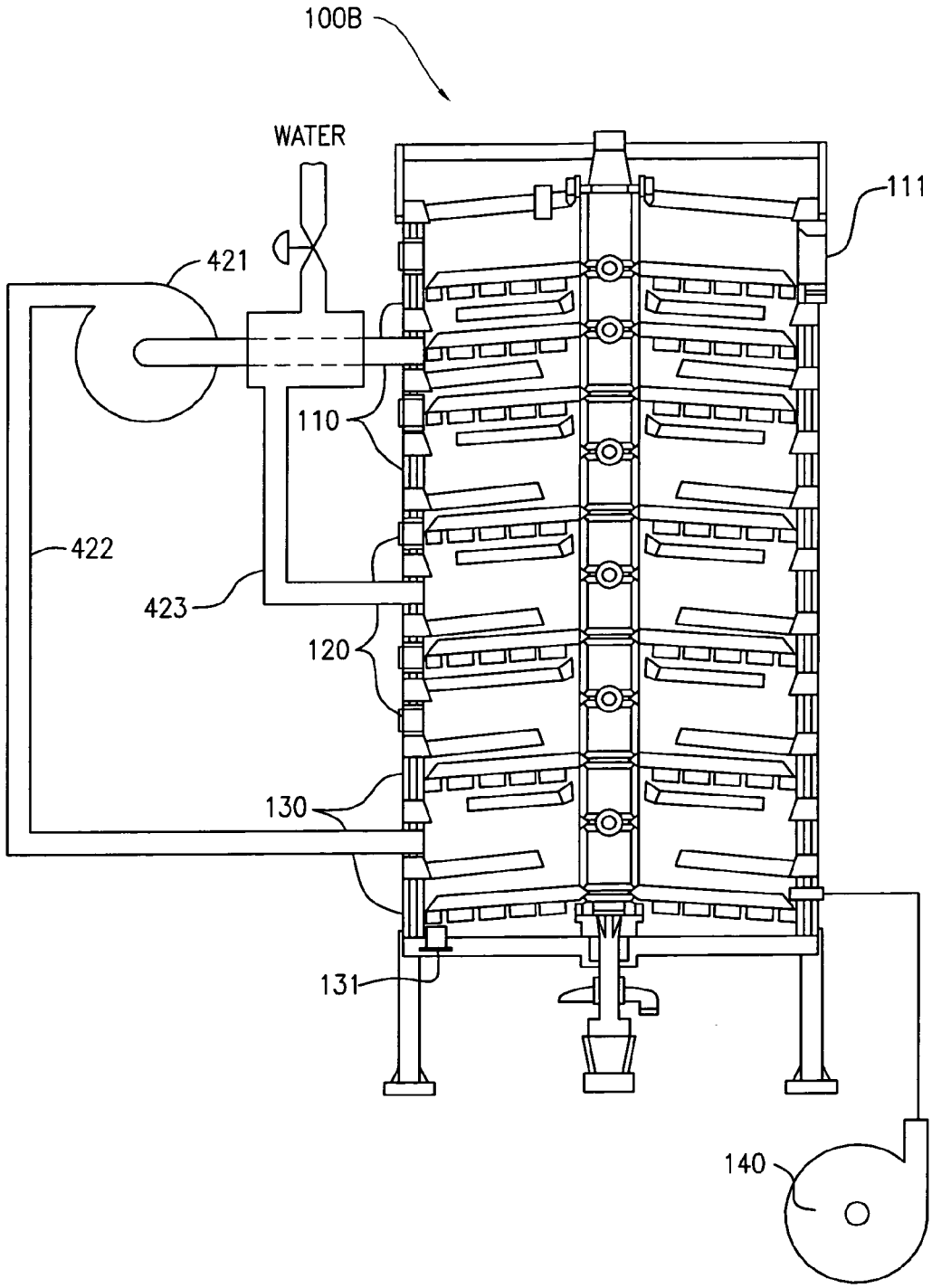
FIG. 3 is another exemplary embodiment of the present invention comprising a recirculation path of the flue gas.

FIG. 3 illustrates a multiple hearth furnace 100B in accordance with another embodiment of the present invention. In this embodiment, the water is heated by the flue gas, but not directly added into the flue gas as in the previous embodiment. Resulting water vapor is introduced to the combustion zone 120 through a separate path 423, but not through the recirculation path 422. This may bring more flexibility in controlling the solid material combustion temperature in the combustion zone 120, e.g., by separately calculating and adjusting the amount of the flue gas to be recirculated and the amount of water vapor to be added to the combustion zone 120.

As shown in FIG. 3, the water vapor is introduced directly into the combustion zone 120, while the flue gas is introduced into the combustion zone 120 from below (through the cooling zone 130). Alternatively, the flue gas is introduced directly into the combustion zone 120, while the water vapor is introduced below the combustion zone 120, or both of the flue gas and the water vapor can be introduced directly into or below the combustion zone 120.

While the above describes the preferred embodiments of the present invention, it shall be appreciated that numerous changes, modifications and adaptations are apparent to those skilled in the art without departing the spirit of the invention. For example, the furnace does not necessarily have to be a multiple hearth furnace as described in the embodiments, but may be any type of furnace having a solid material burning with flue gas above. The water may be heated inside the drying or feed zone 110 by the flue gas instead of in the recirculation path 442. Therefore, the protection scope of the present invention is intended to be solely defined in the accompanying claims.

What is claimed is:

1. A furnace comprising:

a combustion zone for burning solid materials having a residual ash, and a path for feeding flue gas hack to the combustion zone so as to control a temperature in said combustion zone, and means for heating water by the flue gas, wherein said temperature is controlled to be lower than a softening point of said residual ash.

2. The furnace of claim 1 further comprising means for introducing water vapor into said combustion zone.

3. The furnace of claim 2, wherein said water vapor is generated from the water heated by said flue gas.

4. The furnace of claim 3, wherein said water vapor is generated by adding the water into said feeding path so as to be heated by said flue gas.

5. A furnace comprising:

a combustion zone for burning materials, and a path for feeding flue gas back to the combustion zone so as to control a temperature in said combustion zone, and means for heating water by the flue gas, wherein said furnace is a counter-flow multiple hearth furnace further comprising a drying or feed zone above said combustion zone and a cooling zone under said combustion zone, in which said solid materials enter said combustion zone from above through said drying or feed zone while air for burning enters said combustion zone from below through said cooling zone.

6. The furnace of claim 5, wherein said path is arranged to feed said flue gas from said drying or feed zone back to said combustion zone.

7. The furnace of claim 6, wherein said path is arranged to feed said flue gas from said drying or feed zone via said cooling zone back to said combustion zone together with said air.

8. A method of controlling the combustion in a furnace, comprising the steps of introducing flue gas generated from a combustion none back into said combustion zone, heating water by said flue gas, and controlling an amount of said flue gas to be fed hack to said combustion zone according to a temperature of said combustion zone.

9. The method of claim 8, wherein said temperature is a temperature of solid materials to be burned in said combustion zone.

10. The method of claim 9, wherein said amount is controlled such that said temperature is below a softening point of a residual ash in said solid materials.

11. The method of claim 8, wherein water vapor is generated by the step of heating the water.

12. The method of claim 11, further comprising the step of introducing said generated water vapor into said combustion zone.

13. The method of claim 12, said step of heating comprises a step of adding water into said flue gas.

14. The method of claim 13, wherein said water vapor is introduce to said combustion zone together with said flue gas.

* * * * *